United States Patent [19]

Mutter et al.

[11] Patent Number: 4,784,343

[45] Date of Patent: Nov. 15, 1988

[54] ACTUATING SYSTEM FOR A BOBBIN TUBE GRIPPER

[75] Inventors: Heinz Mutter, Winterthur; Ruedi Schneeberger, Seuzach; Erwin Holbein, Uttwil, all of Switzerland

[73] Assignee: Rieter Machine Works Ltd., Winterthur, Switzerland

[21] Appl. No.: 919,652

[22] Filed: Oct. 16, 1986

[30] Foreign Application Priority Data

Oct. 18, 1985 [GB] United Kingdom ..... 8525791

[51] Int. Cl.[4] ..... B65H 54/54

[52] U.S. Cl. ..... 242/46.4

[58] Field of Search ..... 242/46.4, 46.2, 46.3, 242/46.5, 46.6, 72 R, 72.1; 267/141, 141.1, 153

[56] References Cited

U.S. PATENT DOCUMENTS

| | | | |
|---|---|---|---|
| 2,982,536 | 5/1961 | Kordes | 267/153 |
| 3,037,764 | 6/1962 | Paulsen | 267/141 X |
| 3,279,779 | 10/1966 | Thomas et al. | 267/153 |
| 3,305,227 | 2/1967 | Henley | 267/153 |
| 3,493,221 | 2/1970 | Mozdzanowski | 267/153 |
| 3,507,455 | 4/1970 | Andersson . | |
| 3,515,382 | 6/1970 | Gallagher | 267/153 X |
| 3,593,933 | 7/1971 | Grashorn | 242/46.4 |
| 3,757,561 | 9/1973 | Rupert | 267/153 X |
| 4,068,806 | 1/1978 | Moser et al. | 242/46.4 |
| 4,142,690 | 3/1979 | Karle et al. | 242/46.4 |
| 4,232,835 | 11/1980 | Benin . | |
| 4,254,920 | 3/1981 | Peterson | 242/72.1 |
| 4,336,912 | 6/1982 | Greb | 242/46.4 |
| 4,433,814 | 2/1984 | Pontes et al. | 242/72.1 |
| 4,458,850 | 7/1984 | Sugioka et al. . | |

*Primary Examiner*—Stanley N. Gilreath

*Attorney, Agent, or Firm*—Werner W. Kleeman

[57] ABSTRACT

An actuating system for a bobbin tube gripper comprises resilient structure held in compression in order to create a force for urging tube gripping elements into engagement with a tube to be gripped. The resilient structure constitutes a body of a porous elastomer.

13 Claims, 2 Drawing Sheets

Fig. 2
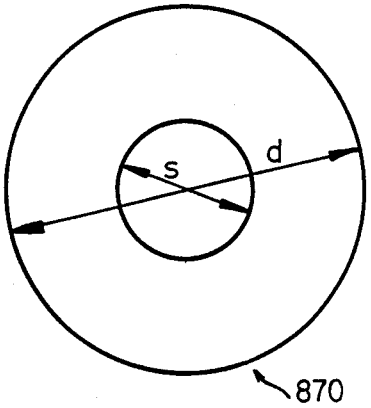
Fig. 3
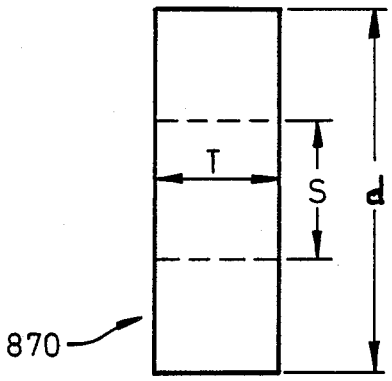
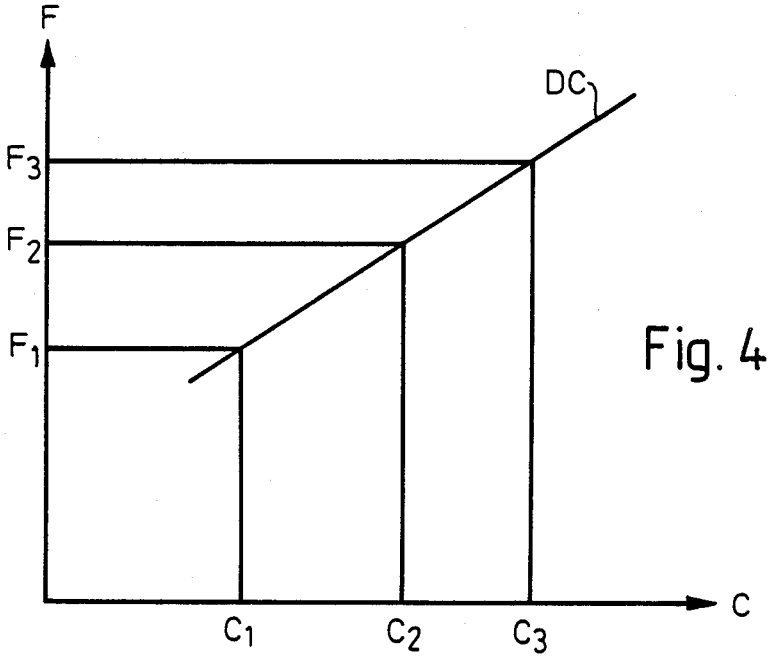
Fig. 4

ACTUATING SYSTEM FOR A BOBBIN TUBE GRIPPER

CROSS-REFERENCE TO RELATED APPLICATION

This application is related to the commonly assigned, copending U.S. application Ser. No. 911,816 filed Sept. 26, 1986, entitled "CHUCK STRUCTURES", the disclosure of which is incorporated herein by reference.

BACKGROUND OF THE INVENTION

The present invention relates to a new and improved construction of an actuating system for a bobbin tube gripping device or bobbin tube gripper.

In its more particular aspects, the present invention specifically relates to a new and improved construction of an actuating system for a bobbin tube gripping device, particularly but not exclusively for securing bobbin tubes relative to a chuck structure in a filament winding machine. Such actuating systems are designed particularly, but not exclusively for use with chuck structures of the type as described in the aforenoted cross-referenced commonly assigned, copending U.S. application Ser. No. 911,816, filed Sept. 26, 1986, entitled "CHUCK STRUCTURES".

In actuating systems for bobbin tube gripping devices such as known, for example, from U.S. Pat. No. 3,052,420, granted Sept. 4, 1962, U.S. Pat. No. 3,554,455, granted Jan. 12, 1971, and 4,068,806, granted Jan. 17, 1978, the bobbin tube gripping device on a chuck in a filament winder contains a wedging "cone" in the shape of a truncated cone which is axially movable in order to urge gripping elements radially outwardly into engagement with the internal surface of a bobbin opposite direction in order to permit the gripping elements to return radially inwardly for releasing the internal surface of the previously gripped bobbin tube. In an alternative system such as known, for example, from U.S. Pat. No. 3,815,836, granted June 11, 1974, and U.S. Pat. No. 4,336,912, granted June 29, 1982, so-called wedging devices of a shape different from the aforementioned wedging cones are employed.

It is also normal practice to urge the wedging devices in the operating or gripping direction by means of a mechanically generated biasing force. Thus, in the absence of a specially applied releasing force, the elements gripping the bobbin tube are normally pressed outward in a gripping direction. Suitable means are of course provided to limit their movement in the outward or gripping direction in the absence of a bobbin tube to be gripped. The release force is normally applied by a pressure-fluid operated device, such as a piston-and-cylinder unit.

The mechanical biasing force is conventionally produced by a spring device and such spring devices have frequently been in the form of so-called "cup-springs" or "Belleville washers". Such spring devices normally comprise a plurality of spring elements, each in the form of a concave/convex disk. The concave/convex disks are arranged neighbor at its outer rim on the concave side and the other neighbor at its inner rim on the convex side. Spring devices increase.

Firstly, there is the problem of unbalance in the chuck structure. Some degree of play is necessary at the assembly stage in order to enable insertion of the spring devices into the remainder of the chuck structure. This leads to problems in centering the spring devices relative to the chuck structure and can lead to shifts of individual elements from the desired positions relative to their neighbors. The resulting slight imbalance is normally acceptable at lower winding speeds such as are encountered at linear thread speeds up to about 4,000 meters per minute, but leads to increasing problems at higher winding speeds.

Secondly, there is the problem of the large number of elements required to provide the relatively high gripping forces which must be produced at higher winding speeds. This problem has a number of aspects. An increasing number of elements takes up additional space within the chuck structure. Furthermore, an increasing number of elements makes it difficult to maintain uniformity of the spring characteristic of the individual elements. As a result, some elements may "collapse" when the spring device is loaded and this produces a non-uniform spring characteristic for the device as a whole. Furthermore, as the number of elements in the spring device rises above 20 to 30, careful checking becomes necessary in order to ensure that the correct number of elements is inserted into each spring device. Finally, the cost of the spring device as a whole becomes significant as the number of elements is substantially increased.

SUMMARY OF THE INVENTION

Therefore, with the foregoing in mind it is a primary object of the present invention to provide a new and improved construction of an actuating system for a bobbin tube gripping device and which actuating system is not afflicted with the limitations and drawbacks of the prior art constructions heretofore discussed.

A further and more specific object of the present invention is directed to providing a new and improved construction of an actuating system for a bobbin tube gripping device and which actuating system exerts a secure grip on the bobbin tubes even during high-speed winding operations.

A still further significant object of the present invention aims at a new and improved construction of an actuating system for a bobbin tube gripping device and which actuating system contains a minimum number of spring elements.

It is another important object of the present invention to provide a new and improved construction of an actuating system for a bobbin tube gripping device and which actuating system produces highly uniform gripping forces throughout the entire range of compression of its resilient structure during operation.

Now in order to implement these and still further objects of the invention, which will become more readily apparent as the description proceeds, the actuating system of the present development is manifested by the feature that, there are provided resilient means held in compression in order to create a force for urging bobbin tube gripping elements into engagement with a bobbin tube to be gripped, and such resilient means constitute a body of a porous elastomer.

In a preferred embodiment of the inventive actuating system for a bobbin tube gripping device, the body of porous elastomer is made up of a plurality of elements formed individually and arranged side by side in the compression direction. Each element preferably is in the form of a disk or a ring. Such elements can be made with substantially standard dimensions which can be chosen to enable maintenance of substantially uniform material quality throughout each element.

The porous elastomer preferably should exhibit a high degree of volume compressibility and a high degree of resistance to compression set. Advantageous characteristics of this kind are provided by polyurethane elastomers.

The body of porous elastomer may be free to deform elastically in response to forces which are applied to such body during its use but, preferably, the body of porous elastomer is confined by engagement with relatively rigid members at least in directions in which deformation is likely to occur in use. In a chuck structure containing the bobbin tube gripping device, the relevant directions are radially outwards in relation to the chuck axis and axially of the chuck.

Advantageously, the inventive actuating system may be combined with a relatively rigid element movable to compress and relax the body of porous elastomer and operable thereby to force bobbin tube gripping elements into contact with a bobbin tube to be gripped or to permit the elements to release a previously gripped bobbin tube. The relatively rigid element may be a wedging cone substantially having the shape of a truncated cone and operable to force the bobbin tube gripping elements radially outwardly when urged axially under a biasing force generated by the body of porous elastomer.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein:

FIGS. 2 and 3 respectively show an axial view and a side view of a resilient element of the type used in the actuating system shown in FIG. 1; and FIG. 4 shows the spring characteristic of the body of porous elastomer used in the actuating system shown in FIG. 1.

DETAILED DESCRIPTION OF THE PREFERRED EMBODIMENTS

Figure 1:
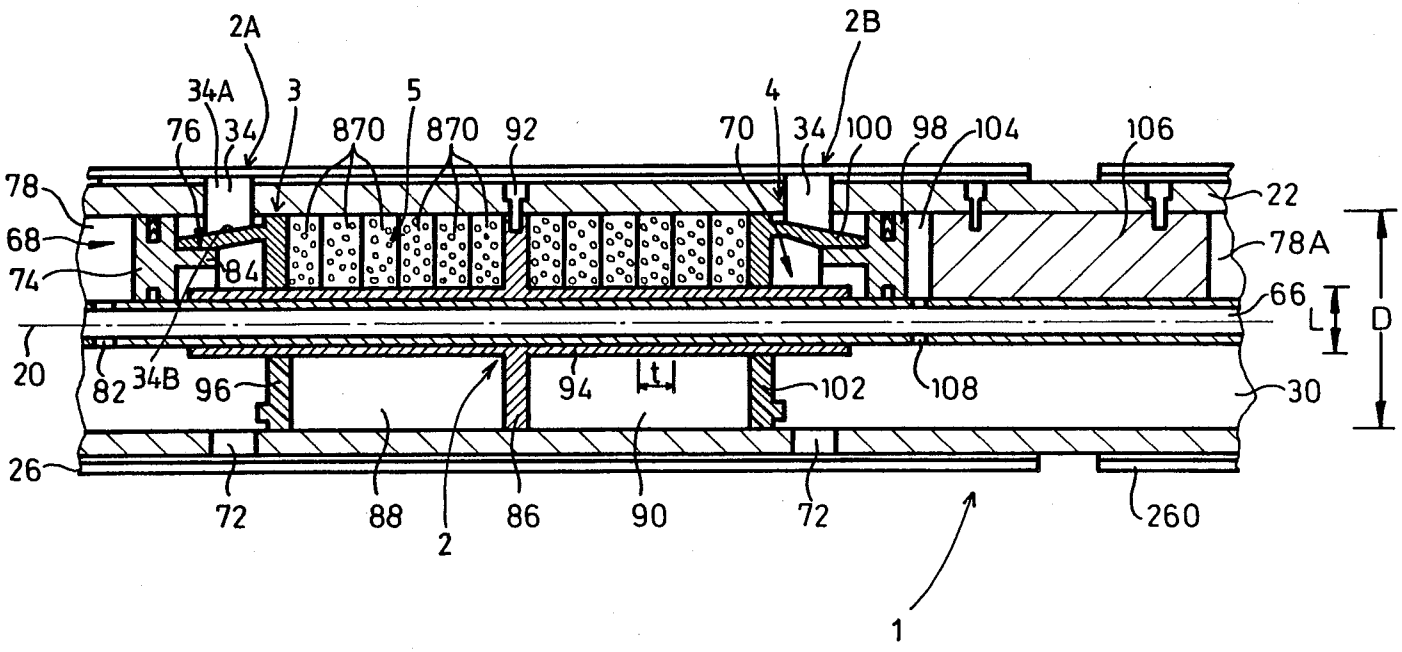
FIG. 1 is a longitudinal section through part of a chuck structure incorporating an exemplary embodiment of the inventive actuating system for bobbin tube gripping devices.

Describing now the drawings, it is to be understood that only enough of the construction of the actuating system and the bobbin tube gripping device have been shown as needed for those skilled in the art to readily understand the underlying principles and concepts of the present development, while simplifying the showing of the drawings. Turning attention now specifically to FIG. 1 of the drawings, there has been shown in longitudinal section part of a chuck structure 1 containing the inventive actuating system. The chuck structure 1 shown in FIG. 1 is cantilever-mounted at a side of FIG. 1. The chuck structure 1 is rotationally journalled in such conventional bearing structure so as to enable rotation of the chuck structure 1 about the longitudinal chuck axis 20. The chuck structure 1, as illustrated, generally corresponds to the chuck structure described in the initially cross-referenced copending, commonly assigned U.S. application Ser. No. 911,816. It will be understood, however, that the inventive actuating system can be employed in conjunction with any other suitable chuck structure or bobbin tube gripping device.

The main structural member of the cantilever-mounted chuck structure 1, that is the portion of the chuck structure 1 outside the bearing support constitutes a tubular portion 22. The external diameter of the tubular portion 22 is selected such as to enable the chuck structure 1 to receive bobbin tubes of which only the bobbin tubes 26 and 260 are visible in FIG. 1 and which are of the type as specified by the machine user. The bobbin tubes 26 and 260 are mounted on the chuck structure 1 by sliding such bobbin tubes axially along the tubular portion 22 from the free end thereof which is not shown but located on the right outside the drawing limits of FIG. 1.

During a thread winding operation, each bobbin tube 26 or 260 must be secured to the chuck structure 1 for rotation conjointly therewith about the chuck axis 20 in order to enable a thread package to be formed on or wound upon each one of the bobbin tubes 26 and 260. Accordingly, for each bobbin tube 26 and 260 a bobbin tube gripping device 2 is incorporated into the chuck structure 1 and only the gripping device 2 for the bobbin tube 26 has been illustrated in FIG. 1. It will be understood, however, that a total number of gripping devices 2 which corresponds to the total number of bobbin tubes supported at the chuck structure 1, is provided at the chuck structure 1.

The major operating elements of the bobbin tube gripping device 2 are mounted in a chamber 30 provided by the interior of the tubular portion 22. In the illustration of FIG. 1, most of the elements of the bobbin tube gripping device 2 have been shown only in the upper half of the figure above the chuck axis 20. It should be understood, however, that the illustrated structure, in face, is symmetrical about the chuck axis 20, as will appear from the following description.

The bobbin tube gripping device 2 for the bobbin tube 26 contains two gripping subassemblies 2A and 2B which are separated from each other by an annular bulkhead 86 secured to the tubular portion 22 of the chuck structure 1 by means of fixing screws 92. This separation of the two gripping subassemblies 2A and 2B ensures that they are independently operable which has certain advantages referred to in the initially cross-referenced copending U.S. application Ser. No. 911,816. There will now be considered first the gripping subassembly 2A which is located on the left of the bulkhead 86 and operates on the inboard portion of bobbin tube 26.

The gripping subassembly 2A comprises a set of bobbin tube gripping elements 34 extending through respective openings 72 in the tubular portion 22. In the illustrated embodiment eight such bobbin tube gripping elements 34 are provided and essentially equiangularly spaced around the chuck axis 20. Any other suitable number of bobbin tube gripping elements 34 can be provided in accordance with the specifically existing requirements. Each bobbin tube gripping element 34 has a radially outer head portion 34A adapted to engage the internal surface of the bobbin tube 26, and a radially inner base or foot portion 34B adapted to slide on a wedging "cone" 76 in substantially the form of a truncated cone. Movement of the wedging cone 76 axially of the chuck structure 1 in the direction to the left as viewed in FIG. 1 will force the cooperating bobbin tube gripping elements 34 radially outwardly into contact with the bobbin tube 26. Conversely, movement of the wedging cone 76 in the opposite direction, i.e. to the right as viewed in FIG. 1 will permit the bobbin tube gripping elements 34 to move radially inwardly to an extent sufficient to release the bobbin tube 26 for removal from the chuck structure 1 and for replacement by a new bobbin tube to be gripped. The wedging cone 76 thus constitutes a relatively or substantially rigid member which is displaceable under the action of a displacement means or operating member 68 to be described hereinbelow such that the bobbin tube gripping elements 34 engage the internal surface of the bobbin tube 26; they are held in engagement therewith under the action of a force which depends upon a preselectable state of compression of resilient means described further hereinbelow.

The wedging cone 76 forms part of the operating member generally designated by the reference numeral 68. Apart from the wedging cone 76, operating member 68 comprises an annular piston element 74 having an integral axial extension 84, and an annular wall element 96 which is integral with the wedging cone 76. The wedging cone 76 is hollow and has a smaller diameter end which fits onto the integral axial extension 84 of the annular piston element 74; the purpose of this arrangement, which is concerned with the assembly of the operating member 68 and the bobbin tube gripping elements 34 within the tubular portion 22, will be described further hereinbelow.

A tube 66 extends substantially, coaxially with the tubular portion 22 and longitudinally of the chamber 30 in the tubular portion 22. The annular piston element 74 is sealed at its outer edge on the internal surface of the tubular portion 22 and at its inner edge on the tube 66 and defines one end of a pressurizable compartment 78. Pressure fluid can be fed into this pressurizable compartment 78 through the tube 66 or any other suitable passage means and openings 82 which are provided in the tube 66 and aligned with the pressurizable compartment 78. When the compartment 78 is suitably pressurized, the annular piston element 74 and thus the wedging cone 76 are forced to the right as viewed in FIG. 1, thereby enabling the set of bobbin tube gripping elements 34 to move radially inwardly in a direction releasing the previously gripped bobbin tube 26.

Normally, however, the tube 66 and the pressurizable compartment 78 are not pressurized, and the annular piston element 74 of the operating member 68 is urged to the left as viewed in FIG. 1 by a mechanical biasing or resilient means 5 provided in a compartment 88 defined between the bulkhead 86 and the annular wall element 96. The mechanical biasing or resilient means 5 constitute an important member of the inventive actuating system 3. Such mechanical biasing or resilient means 5 must be arranged such as to exert a biasing force on the annular wall element 96 urging this annular wall element 96 to the left as viewed in FIG. 1 and thereby causing the wedging cone 76 to urge the bobbin tube gripping elements 34 in a radially outward direction. In the absence of a bobbin tube 26, such radial outward movement of the bobbin tube gripping elements 34 is limited by not particularly illustrated suitable projections on those elements preventing their ejection from the chuck structure 1.

Before turning to a detailed discussion of the mechanical biasing or resilient means 5, the second gripping subassembly 2B for the bobbin tube 26 will be described briefly. As will be readily appreciated from the right-hand portion of FIG. 1, this second gripping subassembly 2B essentially is a mirror image of the first gripping subassembly 2A considered with reference to a plane at right angles to the chuck axis 20 and through the midpoint of bulkhead 86. Thus, the second gripping subassembly 2B also comprises a set of bobbin tube gripping elements 34 which, however, cooperate with the outboard portion of bobbin tube 26. An operating member 70 contains a wedging cone 100 corresponding to the wedging cone 76, an annular piston element 98, an annular wall element 102, a pressurizable compartment 104, one side of which is defined by the annular piston element 98, and which can be pressurized at the same time as the pressurizable compartment 78 via the tube 66 and openings 108 therein, and a compartment 90 defined between the bulkhead 86 and the annular wall element 102 and containing mechanical biasing or resilient means 5 which are substantially the same in all essential aspects as the resilient means 5 contained within the compartment 88.

It will be noted that the annular wall elements 96 and 102 are slidingly fitted at their outer edges to the internal surface of the tubular portion 22 and, at their inner edges, to a tube 94 which is integral with the bulkhead 86 and slidingly fitted on the tube 66. The axial end faces of the tube 94 integrally formed with the bulkhead 86 provide respective end stops for the respective bobbin tube releasing displacements of the annular piston elements 74 and 98.

The mechanical biasing or resilient means 5 in each compartment 88 or 90 comprises an annular body of porous elastomer constituted by a resiliently compressible material substantially filling the whole volume of the compartments 88 or 90. In the embodiment illustrated in FIG. 1, this body of porous elastomer or resiliently compressible material is made up of six elements or rings 870 which are mounted axially side by side on the tube 94 integral with the bulkhead 86 and engage the internal surface of the tubular portion 22 at their outer surfaces. An individual ring 870 shown in FIGS. 2 and 3 in an uncompressed condition, has an internal diameter s, an external diameter d and an axial thickness T. Such rings 870 can be readily manufactured from standard sheets of a suitable material selected in accordance with prevailing requirements so as to provide uniform material quality in each ring 870. Six rings 870 have been shown only by way of example in FIG. 1; there may be provided more or less than six such rings as required by the circumstances. If the material quality can be adequately controlled over an appropriate axial length, then the rings also may be combined to form a single sleeve which fills the compartment 88 or 90.

Each ring 870 constitutes a body of porous elastomer having a high degree of volume compressibility and a low degree of compression set. Polyurethane elastomers are particularly advantageous in this respect. For all possible positions of the annular wall element 96 relative to the bulkhead 86 in the assembled chuck structure 1, each ring 870 is in a state of axial compression when compared with its "normal" or "relaxed" condition illustrated in FIGS. 2 and 3. This is indicated in FIG. 1 by the axial thickness t of each ring 870 and it will be recognized that t is less than T. The external diameter L of the tube 94 integral with the bulkhead 86 may be equal to, greater than or less than s and the internal diameter D of the tubular portion 22 may be equal to, less than or greater than d.

During assembly of the chuck structure 1, the rings 870 are mounted on the tube 94 integral with the bulkhead 86 and within the tubular portion 22 in the relaxed condition and are compressed in situ after assembly with the other parts of the chuck structure 1. Complete filling of the compartment 88 or 90 by the resilient means 5 or the resilient rings 870 is not essential but highly desirable. Extension of the body of porous elastomer or resiliently compressible material between the rigid end members, i.e. the bulkhead 86 and the annular wall element 96 or 102 is of course essential. A less than complete filling of the compartment 88 or 90 therefore results in a radial gap at the inner surface or at the outer surface or both surfaces of each ring 870. This leads to incomplete utilization of the space available in the compartment 88 or 90 and a higher loading per unit area of cross-section of the body of porous elastomer or resiliently compressible material. Furthermore, if the body of porous elastomer or resiliently compressible material is deformable under centrifugal forces which may arise in use, and a gap is present at standstill between the outer surfaces of the rings 870 which constitute the body of porous elastomer, and the wall, i.e. the tubular portion 22 surrounding the compartment 88 or 90, as the case may be, then the rings 870 may deform unevenly during operation and cause imbalance of the chuck structure 1 as a whole. Accordingly, at least contact of the outer surfaces of the rings 870 with the tubular portion 22 is an extremely desirable feature and such tubular portion 22 constitutes a substantially rigid member engaged by the rings 870 in their deformation direction.

The resiliently compressible material to be used in the rings 870 is chosen by reference to the required performance characteristic of the mechanical biasing or resilient means 5. Such performance characteristic is shown in graphical form in FIG. 4 in which the horizontal axis represents axial compression C in terms of distance or proportion of relaxed length or any other convenient unit of the body of porous elastomer or resiliently compressible material as a whole. The vertical axis represents the resultant or axial compression force F applied by the compressed body of porous elastomer or resiliently compressible material to the annular wall element 96 or 102. This resultant or axial compression force F represents the axial force available to wedge the associated bobbin tube gripping elements 34 outwardly into contact with the bobbin tube 26.

For a given design of the chuck structure 1, a design characteristic DC can be defined for the body of porous elastomer or resiliently compressible material. This design characteristic DC is derived from the physical characteristics and required performance of the chuck structure 1 and must be established on a case to case basis. In general, the required resultant force F will be dependent upon the size of the thread package which must be wound upon the bobbin tube 26 on the chuck structure 1 and the available compression will be given by the dimensions of the wedging cone 76 and the required radial movement of the associated set of bobbin tube gripping elements 34, bearing in mind the practical variation in nominal internal diameters of the bobbin tubes 26 with which the chuck structure 1 has to operate in use. FIG. 4 assumes a linear design characteristic DC. This is not essential, but will be assumed for convenience of description. During the following discussion, reference will be made only to the compartment 88 bounded by the bulkhead 86 and the annular wall element 96 which is displaceable to the left as viewed in FIG. 1, under the action of the resultant or axial compression force F generated by the body of porous elastomer or resiliently compressible material, particularly the rings 870 confined to the compartment 88. It will be self-evident that the same discussion analogously applies to the compartment 90 bounded by the bulkhead 86 and the annular wall element 102 for the corresponding interaction of the associated set of bobbin tube gripping elements 34 with the associated other end of the bobbin tube 26.

As indicated in FIG. 4, there are three significant points on the design characteristic DC. At the first significant point, namely at the compression $C_1$ and the associated resultant or axial compression force $F_1$ the degree of compression $C_1$ is at its operational minimum and the volume of the compartment 88 is at its operational maximum which condition corresponds to a bobbin tube 26 with the maximum designed internal diameter. The "spring characteristic" of the body of porous elastomer or resiliently compressible material must be selected such that under this condition a minimum resultant or axial compression force $F_1$ is directed to the left and exerted upon the annular wall element 96 and the associated set of bobbin tube gripping elements 34 can exert a predetermined corresponding minimum gripping force upon the bobbin tube 26. In the absence of the bobbin tube 26, the resiliently compressible material can expand the compartment 88 still further and thus further reduce the compression C until the aforementioned projections or retaining stops provided at the bobbin tube gripping elements 34 engage the tubular portion 22. The resultant or axial compression force F applied to the annular wall element 96 will then drop below the level $F_1$, but this is not operationally significant because no gripping operation is performed under these conditions.

The second significant point on the design characteristic DC exists at the compression $C_2$ and the associated resultant or axial compression force $F_2$ and represents a movement of the annular wall element 96 to the right as viewed in FIG. 1, with radial retraction of the associated set of bobbin tube gripping elements 34 to engage the internal surface of a bobbin tube 26 having the minimum designed internal diameter. The corresponding resultant or axial compression force $F_2$ must be selected such that the bobbin tube gripping elements 34 do not penetrate unduly into the wall thickness of such bobbin tube 26 and thereby damage the bobbin tube 26. This consideration may become even more relevant in the course of a package winding operation than at the time of first contact of the bobbin tube gripping elements 34 with the bobbin tube 26, as will become clear from the immediately following discussion of the third significant point on the design characteristic DC and which is associated with a compression $C_3$ and a resultant or axial compression force $F_3$.

The compression $C_3$ represents a movement of the annular wall element 96 to the right as viewed in FIG. 1 and a corresponding radially inward movement of the associated set of bobbin tube gripping elements 34 in order to ensure that the bobbin tube gripping elements 34 will effectively release the bobbin tube 26 carrying a wound package for removal of the package and replacement thereof by a fresh bobbin tube. The degree of compression required for this purpose depends to a large extent upon the winding operation itself. Thus, if a thread is wound under substantial tension to form a large thread package, then the bobbin tube 26 is compressed radially inwardly during the package winding operation. As indicated in FIG. 1, the internal bobbin tube surface is normally spaced from the outer surface of the tubular portion 22 at the start of a winding operation because of the slight projection of the associated set of bobbin tube gripping elements 34 beyond the cylindrical outer surface of the tubular portion 22. The compression of the bobbin tube 26 during a winding operation, however, can force the internal surface of the bobbin tube 26 into contact with the external surface of the tubular portion 22 of the chuck structure 1. As previously indicated, the resultant or axial compression forces within the range of $F_2$ to $F_3$ must be selected such that there is no undue penetration of the bobbin tube gripping elements 34 into the wall thickness of bobbin tube 26 and the bobbin tube gripping elements 34 should "give" as the bobbin tube 26 is compressed.

As will be described later in this specification, for the exemplary embodiment illustrated in FIG. 1, a fourth significant point (not shown) can be identified on the design characteristic DC. Since this point is related to the assembly of the illustrated embodiment and not to the operation in use, description of this aspect will be delayed until the assembly process itself is described.

When a design characteristic DC has been established, it must be compared with the spring characteristics from materials suppliers to enable selection of an appropriate "shortlist" of materials. The final choice of material will, however, take other factors into account depending upon the required circumstances of use, for example compression set which constitutes an aging effect under which the material loses some of its resilience when compressed continuously over a period of time and such aging effect is of significance in relation to the required life-span of the mechanical biasing or resilient means 5, resistance to substances which may penetrate the compartment 88 in use or which may be present during the assembly stage, for example oils, acids, etc., response of the material in terms of radial expansion to centrifugal forces in use, etc. If the compartment 88 is not completely filled by the body of porous elastomer or resiliently compressible material, then, the ability of the body of porous elastomer or resiliently compressible material to resist transverse bending under axial load may also be significant, depending upon the play available between such body of material and its transverse guiding or confining surfaces. For this reason also, it is preferred that the body of porous elastomer or resiliently compressible material is effectively guided at its inner surface e.g. by contact with the tube 94 integrated with the bulkhead 86 and/or confined e.g. by contact with the internal surface of the tubular portion 22.

A polyurethane elastomer supplied by Getzner Chemie GmbH of Bludenz-Buers in Austria under the registered trademark SYLOMER has proved to be suitable. From the range of materials supplied by Getzner Chemie under that trademark, the "S" type is preferred. The material is available in a sheet form suitable for formation of the aforementioned rings 870. According to the data available from the supplier, this material is suitable for elastic deformation of up to 40% of the original sheet thickness. Purely by way of example, the following data relate to a practical design using the "SYLOMER" material in a chuck structure like the chuck structure 1 and designed for use with bobbin tubes 26 having a nominal internal diameter of 75 mm.

Internal diameter of tubular portion 22: 57 mm.

Maximum length of compartment 88 (90): 60 mm.

Travel of annular wall element 96 (102) corresponding to a shift from the compression point $C_1$ to the compression point $C_2$ in FIG. 4: 3.3 mm.

Travel of annular wall element 96 (102) corresponding to a shift from the compression point $C_2$ to the compression point C in FIG. 4: 4.7 mm.

Number of rings 870, FIG. 1: 8 (4).

Axial thickness T (FIG. 3) of each ring 870 in the relaxed or uncompressed condition: 11 mm (22 mm).

External diameter d (FIG. 2) of each ring 870 in the relaxed or uncompressed condition: 52 mm.

Internal diameter s (FIG. 2) of each ring 870 in the relaxed or uncompressed condition: 15 mm.

Material type: SYLOMER SB

As indicated in the foregoing list, the total uncompressed axial length of the body of porous elastomer or resilient compressible material provided by the rings 870 is 88 mm and this can be made up alternatively by eight rings of 11 mm each or four rings of 22 mm each. The degree of radial expansion of each ring 870 under the compression produced in the compartment 88 even in the maximum-volume condition of the compartment 88 is sufficient to cause firm contact between the outer surface of each ring 870 and the internal surface of the tubular portion 22.

The chuck design based on the data listed hereinbefore is intended for rotation about the chuck axis 20 in order to enable take-up of thread at linear speeds up to 6000 revolutions per min. Centrifugal forces acting on the rings 870 would tend to deform the material of such rings radially outwardly against the tubular portion 22. Since the rings 870 are already in contact with the internal surface of the tubular portion 22 even at standstill, such additional radial deformation is not possible and the resultant effect is an increase in the resultant or axial compression force F applied to the annular wall element 96. This is an additional reason for the preference for guiding contact of the rings 870 with the internal surface of the tubular portion 22 rather than with the tube 94 which is integrated with the bulkhead 86. Otherwise, due to the centrifugal forces arising during operation and the resultant deformation of the body of porous elastomer or resiliently compressible material, contact with the internal tube 94 integrated with the bulkhead 86 can be lost.

The chuck design described above is suitable for a chuck length of the cantilevered tubular portion 22 of approximately 600 mm. An alternative design, suitable for a corresponding chuck length of approximately 900 mm and usable with bobbin tubes 26 of nominal internal diameter 94 mm is given below:

Internal diameter of tubular portion 22: 75 mm

Maximum length of compartment 88 (90): 48.2 mm

Number of rings 870, FIG. 1: 3

Axial thickness T (FIG. 3) of each ring 870 in its relaxed or uncompressed condition: 21 mm External diameter d (FIG. 2) of each ring 870 in its relaxed or uncompressed condition: 67 mm Internal diameter s (FIG. 2) of each ring 870 in its relaxed or uncompressed condition: 15 mm Material type: SYLOMER S Travel of annular wall element 96 corresponding to a shift from the compression point $C_1$ to the compression point $C_2$ in FIG. 4: 3.3 mm Travel of annular wall element 96 corresponding to a shift from the compression point $C_2$ to the compression point $C_3$ FIG. 4: 9.4 mm This chuck structure is also designed for take-up of thread at linear speeds up to 6000 revolutions per min. As in the case of the previous design, the compression of the body of porous elastomer or resiliently compressible material even in the maximum-volume condition of the related compartment 88 or 90 is such that the external surface of each ring 870 contacts the internal surface of the tubular portion 22. Furthermore, as noted above, the contact pressure between the body of porous elastomer or resiliently compressible material and the internal surface of the tubular portion 22 is increased at the operating speed due to the existing centrifugal force. On the other hand, the body of porous elastomer or resiliently compressible material is required to "work" slightly in the related compartment 88 or 90 even during a given winding operation, e.g. because of the return of the set of bobbin tube gripping elements 34 radially into the tubular portion 22 as the gripped bobbin tube 26 is overwound during package formation. It is important that the friction arising between each ring 870 and the internal surface of the tubular portion 22 should not interfere with this "working". In order to avoid such interference, it may be desirable to provide a lubricant e.g. a silicon oil or grease between the internal surface of the tubular portion 22 and the external surface of the body of porous elastomer or resiliently compressible material made up by the rings 870.

The "release" force required to overcome the biasing or axial compression force F applied from the compartment 88 (90) is provided by pressurization of the pressurizable compartment 78 (104) from the tube 66. The maximum degree of compression of the body of porous elastomer or resiliently compressible material by pressurization of the pressurizable compartment 78 (104) is limited by engagement of the annular piston element 74 (98) with an axial end stop which is provided in the exemplary embodiment illustrated in FIG. 1 by the adjacent axial end face of the tube 94 integrated with the bulkhead 86. As will now be described, for the purposes of assembly the body of porous elastomer or resiliently compressible material is required to withstand a degree of compression C which is greater than the compression represented by the compression point $C_3$ and the resultant or axial compression force $F_3$ in FIG. 4. Analogous conditions exist during simultaneous application of a release force at the other end of the bobbin tube 26 by pressurizing the pressurizable compartment 104 from the tube 66.

The internal components of the chuck structure 1 that is, the components retained within the tubular portion 22 are mounted in such tubular portion 22 by insertion through the open or free end which is not shown but located on the right outside the drawing limits of FIG. 1. During the course of the aforementioned assembly of the components already described with reference to FIG. 1, the bobbin tube gripping elements 34 associated with the operating member 68 can be located in their respective openings 72 in the tubular portion 22 before insertion of the wedging cone 76 and assembly thereof with the axial extension 84 integral with the pre-assembled annular piston element 74. However, the wedging cone 100 in the operating member 70 operatively associated with the other end of the bobbin tube 26, must be inserted into the tubular portion 22 prior to the associated set of bobbin tube gripping elements 34. In order to provide sufficient space for location of the bobbin tube gripping elements 34 of the operating member 70 in the respective openings 72, the annular wall element 102 must be pressed in the axial direction towards the bulkhead 86 to produce a relatively high degree of compression of the rings 870 in the compartment 90. The design characteristic DC of the body of porous elastomer or resiliently compressible material as shown in FIG. 4 must therefore permit a fourth significant compression point $C_4$ with the associated resultant or axial compression force $F_4$ located on the right of those already illustrated in FIG. 4 and such fourth significant compression point corresponds to this degree of "assembly compression".

The combination of the pressurizable compartment 78 (104), the operating member 68 (70), the confining compartment 88 (90) and the body of porous elastomer or resiliently compressible material made up by the rings 870 constitutes the actuating system 3. An analogous actuating system 4 constitutes the combination of the pressurizable compartment 104, the operating member 70, the confining compartment 90 and the associated body of porous elastomer or resiliently compressible material made up by the rings 870. These actuating systems 3 and 4, in turn, are part of a bobbin tube gripping device 2 comprising the two actuating systems 3 and 4 on either side of the bulkhead 86 in FIG. 1 and the sets of bobbin tube gripping elements 34 associated therewith. Only the one bobbin tube gripping device 2 which is associated with the inboard bobbin tube 26, has been shown in FIG. 1; for each other bobbin tube, e.g. the bobbin tube 260 shown in FIG. 1, a similar, individual bobbin tube gripping device must be provided. In the exemplary embodiment illustrated in FIG. 1, the bobbin tube gripping device 2 operating on the bobbin tube 26 is separated from the corresponding bobbin tube gripping device operating upon the bobbin tube 260 by a unit 106 which is not relevant to the present invention and will not be described herein. The unit 106, however, is described in full in the initially cross-referenced copending U.S. application Ser. No. 911,816. On the right of the unit 106 the inboard end of a pressurizable compartment 78A of the bobbin tube gripping device associated with the bobbin tube 260 can be seen. The tube 66 supplying pressure fluid to the pressurizable compartments 78, 104 and 78A is common to all of the bobbin tube gripping devices assembled on the entire chuck structure 1.

The invention is not limited to details of the illustrated exemplary embodiment. The chuck design in particular has been shown only by way of example; the inventive actuating system can also be used with radically different chuck designs. The choice of material for the body of porous elastomer or resiliently compressible material is not limited to polyurethane elastomers. Other porous elastomers providing equivalent or comparable relevant properties relevant to this mode of use can be substituted.

The ring elements 870 are shown in FIGS. 2 and 3 as having cylindrical inner and outer surfaces. However, such cylindrical inner and outer surfaces are not required. For example, the outer surface could be provided with a plurality of recesses, preferably evenly distributed around the axis of the ring 870. Due to the compression during assembly, the recesses may be "filled" when each ring 870 is in place in the chuck structure 1 but this also may not be essential provided adequate centering effect is available from the actually produced contact with the tubular portion 22.

While there are shown and described present preferred embodiments of the invention, it is to be distinctly understood that the invention is not limited thereto, but may be otherwise variously embodied and practiced within the scope of the following claims. Accordingly,

What we claim is:

1. An actuating system operating on bobbin tube gripping elements of a bobbin tube gripping device and comprising:

resilient means capable of assuming predeterminate states of compression, means defining a confinement compartment bounded by an internal surface;

said resilient means contacting said internal surface of said confinement compartment;

said means defining said confinement compartment further including a movable member for holding said resilient means in at least one preselectable state of compression in which said resilient means generate a force operable to grippingly engage the bobbin tube gripping elements with the bobbin tube;

said resilient means constituting a body of porous elastomer enabling generation of said at least one preselectable state of compression with said resilient means in contact with said internal surface of said confinement compartment; and said body of porous elastomer of said resilient means substantially filling said confinement compartment when generating said force to gripping engage the bobbin tube gripping elements with the bobbin tube.

2. The actuating system as defined in claim 1, wherein:

said means defining said confinement compartment including said movable member for holding said resilient means in said at least one preselectable state of compression, define a predetermined compression direction;

said body of porous elastomer containing a predeterminate plurality of individual elements forming said body of porous elastomer; and said plurality of individual elements of said body of porous elastomer being arranged in a side-by-side relationship with respect to said predetermined compression direction.

3. The actuating system as defined in claim 2, wherein:

each said individual element of said body of porous elastomer constitutes a substantially disk-shaped element.

4. The actuating system as defined in claim 2, wherein:

each said individual element of said body of porous elastomer constitutes a substantially ring-shaped element.

5. The actuating system as defined in claim 2, wherein:

said porous elastomer of said body of porous elastomer possesses a high degree of volume compressibility; and said porous elastomer of said body of porous elastomer possessing a high resistance to compression set.

6. The actuating system as defined in claim 3, wherein:

each said individual substantially disk-shaped element of said body of porous elastomer possesses a high degree of volume compressibility; and each said individual substantially disk-shaped element of said body of porous elastomer possesses a high resistance to compression set.

7. The actuating system as defined in claim 4, wherein:

each said individual substantially ring-shaped element of said body of porous elastomer possesses a high degree of volume compressibility; and each said individual substantially ring-shaped element of said body of porous elastomer possesses a high resistance to compression set.

8. The actuating system as defined in claim 5, wherein:

said porous elastomer of said body of porous elastomer constitutes a porous polyurethane elastomer.

9. The actuating system as defined in claim 1, wherein:

said means defining said confinement compartment including said movable member containing at least one substantially rigid member;

said body of porous elastomer being subject to deformation in a predetermined deformation direction;

said at least one substantially rigid member of said confinement means being arranged with respect to said body of porous elastomer in said predetermined deformation direction; and said body of porous elastomer being confined by and engaging said at least one substantially rigid member of said confinement means.

10. The actuating system as defined in claim 1, wherein:

said movable member of said means defining said confinement compartment comprising a substantially rigid element displaceable relative to said body of porous elastomer in a predetermined compression direction in order to subject said body of porous elastomer to said predeterminate states of compression;

displacing means for displacing said substantially rigid element relative to said body of porous elastomer;

said substantially rigid element being displaceable under the action of said displacing means and thereby compressing said body of porous elastomer to a first predetermined state of compression in which there is generated said force operable to grippingly engage the bobbin tube gripping elements with the bobbin tube; and said substantially rigid element being displaceable under the action of said displacement means and thereby compressing said body of porous elastomer to a second predeterminate state of compression permitting release of said bobbin tube from said bobbin tube gripping elements.

11. The actuating system as defined in claim 10, wherein:

said movable member comprising said substantially rigid element constitutes a wedging cone.

12. A chuck structure for use in a winding machine and having an axis of rotation, said chuck structure comprising:

a first elongated tubular portion with an external circumference adapted to receive at least one bobbin tube for rotation about the axis of rotation;

a second elongated tubular portion extending substantially coaxially in said first elongated tubular portion;

resilient means constituting a body of porous elastomer;

said first elongated tubular portion and said second elongated tubular portion conjointly defining a chamber accommodating said body of porous elastomer and bounded by a stationary member at which said body of porous elastomer is supported, and a displaceable substantially rigid element;

said first elongated tubular portion, said second elongated tubular portion, said stationary member and said displaceable substantially rigid element defining a confinement compartment within which there is located said body of porous elastomer;

said confinement compartment including an internal surface against which contactingly bears said resilient means;

displacement means acting upon said displaceable substantially rigid element in order to thereby subject said body of porous elastomer to preselectable states of compression;

a predetermined number or bobbin tube gripping elements operatively associated with said at least one bobbin tube and extending through a predetermined number of openings in said first elongated tubular portion;

said predetermined number of bobbin tube gripping elements engaging said displaceable substantially rigid element and cooperating with said bobbin tube during displacement of said substantially rigid element such that, in a first state of compression of said body of porous elastomer under the action of said displaceable substantially rigid element, said predetermined number of bobbin tube gripping elements are held in gripping engagement with said at least one bobbin tube under a predeterminate force generated by said body of porous elastomer in said first state of compression, and in a second state of compression of said body of porous elastomer under the action of said displaceable substantially rigid element, said body of porous elastomer permits release of said bobbin tube from said predetermined number of bobbin tube gripping elements;

said body of porous elastomer due to its porosity enabling assumption of the first state of compression and the second state of compression of said body of porous elastomer even through the resilient means contacts the internal surface of the confinement compartment; and said body of porous elastomer substantially filling the confinement compartment when said body of porous elastomer is in said first state of compression so as to generate said predeterminate force for holding said predetermined member of bobbin tube gripping elements in gripping engagement with said at least one bobbin tube.

13. The chuck structure as defined in claim 12, wherein:

said displaceable substantially rigid element constitutes a wedging cone.

* * * * *

UNITED STATES PATENT AND TRADEMARK OFFICE

CERTIFICATE OF CORRECTION

PATENT NO. : 4,784,343

DATED : November 15, 1988

INVENTOR(S) : HEINZ MUTTER et al

It is certified that error appears in the above-identified patent and that said Letters Patent is hereby corrected as shown below:

Column 1, line 30, after "and" please insert --United States Patent No.--

Column 1, line 61, after "arranged" please insert --side by side in axial direction so that each disk contacts one--

Column 1, line 63, after "devices" please insert --of this type lead to a number of problems as winding speeds--

Column 3, line 60, after "a" please insert --not particularly illustrated bearing structure in the left-hand--

Column 4, line 36, please delete "face" and insert --fact--

Column 8, line 14, please delete "$C_1$" and insert --C--

Column 10, line 6, delete "C" and insert --$C_3$--

Column 15, line 21, please delete "or" and insert --of--

Signed and Sealed this

Eleventh Day of July, 1989

*Attest:*

*Attesting Officer*

DONALD J. QUIGG

*Commissioner of Patents and Trademarks*